US011940258B2

(12) United States Patent
Buchanan

(10) Patent No.: US 11,940,258 B2
(45) Date of Patent: Mar. 26, 2024

(54) ILLUMINATED NOCK

(71) Applicant: WATASH OUTDOORS Inc, Carmichaels, PA (US)

(72) Inventor: Howard Andrew Buchanan, Burnsville, NC (US)

(73) Assignee: CenterCross Archery LLC, Burnsville, NC (US)

( * ) Notice: Subject to any disclaimer, the term of this patent is extended or adjusted under 35 U.S.C. 154(b) by 0 days.

(21) Appl. No.: 18/071,744

(22) Filed: Nov. 30, 2022

(65) Prior Publication Data

US 2023/0175821 A1 Jun. 8, 2023

Related U.S. Application Data

(60) Provisional application No. 63/285,192, filed on Dec. 2, 2021.

(51) Int. Cl.
*F42B 6/06* (2006.01)

(52) U.S. Cl.
CPC ..... *F42B 6/06* (2013.01)

(58) Field of Classification Search
CPC ..... F42B 6/06
See application file for complete search history.

(56) References Cited

U.S. PATENT DOCUMENTS

| | | | | |
|---|---|---|---|---|
| 3,034,789 | A * | 5/1962 | Moore | F42B 6/06 473/578 |
| 4,823,762 | A * | 4/1989 | Pugh | F42B 6/06 124/25.7 |
| 6,123,631 | A * | 9/2000 | Ginder | F42B 12/362 473/578 |
| 6,736,742 | B2 * | 5/2004 | Price | F42B 12/382 473/578 |
| 8,944,944 | B2 * | 2/2015 | Pedersen | F42B 12/42 473/578 |
| 9,702,671 | B2 | 7/2017 | Minica | |

* cited by examiner

*Primary Examiner* — John A Ricci
(74) *Attorney, Agent, or Firm* — Technology Law, PLLC

(57) ABSTRACT

A nock assembly for use with a crossbow bolt includes a nock body defining a notch into which the bowstring of a crossbow is insertable. A light assembly includes a switch member at one end of the notch. First and second spherical caps protrude into the notch and define a first gap therebetween. Third and fourth spherical caps protrude into the notch and define a second gap therebetween. The bowstring is positionable between the spherical caps such that the first and second spherical caps resist movement of the bowstring out of the notch, and the third and fourth spherical caps resist movement of the bowstring toward the switch member. Release of the bowstring from its cocked or drawn position causes the bowstring to pass through the second gap and contact the switch member to turn on the light assembly.

16 Claims, 4 Drawing Sheets

ILLUMINATED NOCK

CROSS-REFERENCE TO RELATED APPLICATION

This application claims the benefit of U.S. Provisional Patent Application No. 63/285,192, filed Dec. 2, 2021, and which is hereby incorporated by reference in its entirety.

TECHNICAL FIELD

This disclosure relates to nocks for arrows and crossbow bolts.

BACKGROUND OF THE INVENTION

Hunters often use arrows or crossbow bolts when hunting game. When the arrow or bolt is released and travels toward a target animal, it is helpful for the archer to view the flight path of the arrow or bolt and where it impacts the target animal. Arrows having nocks that are illuminated are sometimes employed. Illuminated nocks enhance the visibility of the arrow during flight and may aid in the tracking and retrieval of the animal if the animal moves after impact.

Prior art illuminated nocks typically include a battery and a light-emitting diode (LED) or other light-emitting device such as a small incandescent bulb. Although illuminated nocks may greatly assist hunters, prior art illuminated nocks have several drawbacks. To prevent the battery from being depleted, illuminated nocks must be kept "off," i.e., the LED must be electrically disconnected from the battery during storage. Accordingly, with many prior art illuminated nocks, a hunter must take the time to manipulate the nock to electrically connect the LED to the battery.

A hunter may lose the opportunity to take a shot at the target animal due to the time required to turn the LED on. Furthermore, the additional movement required to turn the LED on, or the LED itself, may alert the target animal to the presence of the hunter.

At least one attempt has been made to provide an illuminated nock that turns on automatically when launched from the bowstring of a bow or crossbow, but the interaction between the bowstring and the nock could negatively affect the arrow during launch, thereby significantly reducing accuracy, speed, and range of the arrow.

SUMMARY

According to one aspect of the disclosure, a nock assembly for attachment to an arrow or crossbow bolt includes a nock body. The nock body includes first and second surfaces that cooperate to define a notch therebetween. First and second spherical caps protrude into the notch from the first and second surfaces, respectively. The first and second spherical caps define a first gap therebetween. The first gap is narrower than the diameter of a bowstring, thereby retaining the bowstring within the notch before the bowstring is released by an archer or by a crossbow.

According to another aspect of the disclosure, the nock assembly includes a light assembly that is configured to turn on and emit light in response to the bowstring contacting the terminal end of the notch. The nock assembly also includes third and fourth spherical caps that protrude into the notch from the first and second surfaces, respectively. The third and fourth spherical caps define a second gap therebetween that is narrower than the diameter of the bowstring. The third and fourth spherical caps prevent the bowstring from reaching the terminal end of the notch and turning on the light assembly until the bowstring is released from its drawn or cocked position; the force of the released bowstring will overcome the resistance provided by the third and fourth spherical caps, causing the bowstring to reach the terminal end and turning on the light.

According to yet another aspect of the disclosure, the first gap is slightly larger than the second gap. According to yet another aspect of the disclosure, the spherical caps are sized and positioned to provide four points of tangency, i.e., four tangential points of contact onto the bowstring. According to yet another aspect of the disclosure, each spherical cap is formed by a respective ball bearing that is press-fit into a respective aperture formed in the nock body.

The above features and advantages and other features and advantages of the present disclosure are readily apparent from the following detailed description of the best modes for carrying out the disclosure when taken in connection with the accompanying drawings.

DETAILED DESCRIPTION

Figure 6:
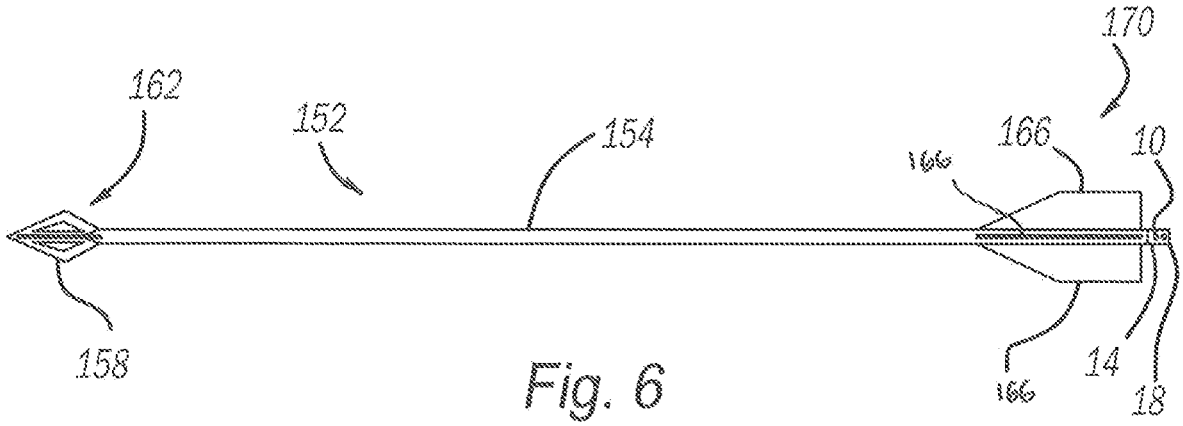
FIG. 6 is a schematic, side view of an arrow or cross-bow bolt having a shaft to which the nock assembly is operatively connected.

Referring to the Figures, wherein like reference numbers refer to like components throughout, a nock assembly 10 is schematically depicted. The nock assembly 10 includes a nock member or body 14 having a nock portion 18 and a stem portion 22. The body 14 may be formed of a single piece of material as shown, or may comprise multiple pieces of material operatively interconnected to form a body 14 within the scope of the claimed invention. The stem portion 22 has an outer surface 26 matable with an arrow or crossbow bolt shaft as shown in FIG. 6. It should be noted that "arrow" and "crossbow bolt" may be used interchangeably herein. Similarly, the terms "bow" and "crossbow" may be used interchangeably herein. The nock portion 18 defines a notch 30. More specifically, the nock portion 18 includes two substantially parallel arms 34, 38 that define the notch 30 therebetween. The notch 30 has an opening 42 at one end for insertion of a bowstring, and terminates at an end 44 opposite the opening 42.

The nock body 14 defines a first bore 46 extending from one end 50 of the nock member 14 to the notch 30. More specifically, the first bore 46 extends through the terminal end 44 of the notch 30 such that the first bore 46 is contiguous with the notch 30. The nock body 14 also defines a second bore 54 extending perpendicularly to, and intersecting, the first bore 46.

Figure 1:
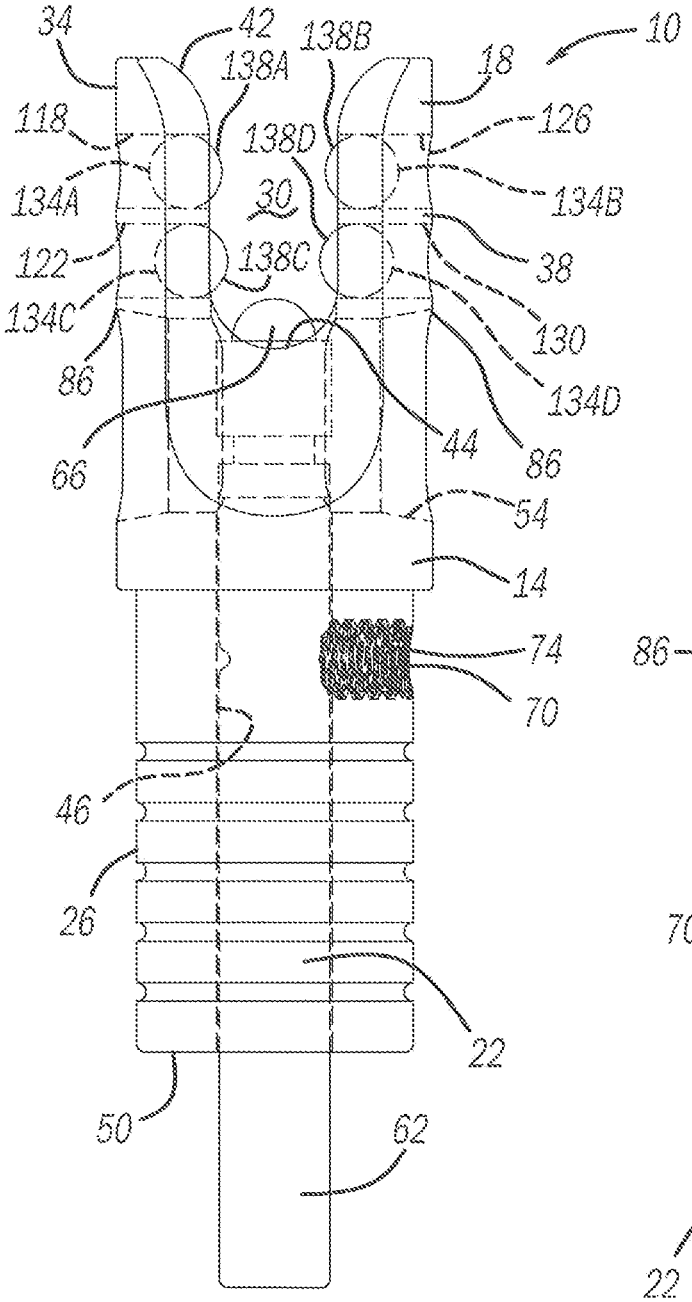
FIG. 1 is a schematic, side view of a nock assembly having a body that defines a notch, and first, second, third, and fourth ball bearings protruding into the notch in accordance with the claimed invention.
Figure 2:
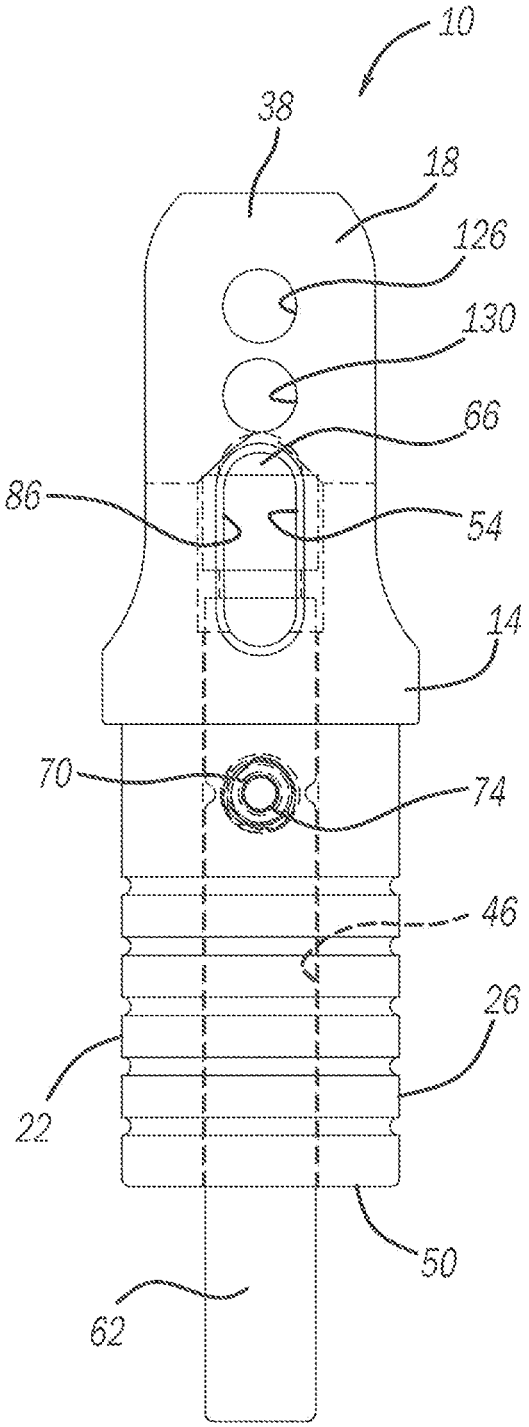
FIG. 2 is a schematic, front view of the nock assembly of FIG. 1.
Figure 3:
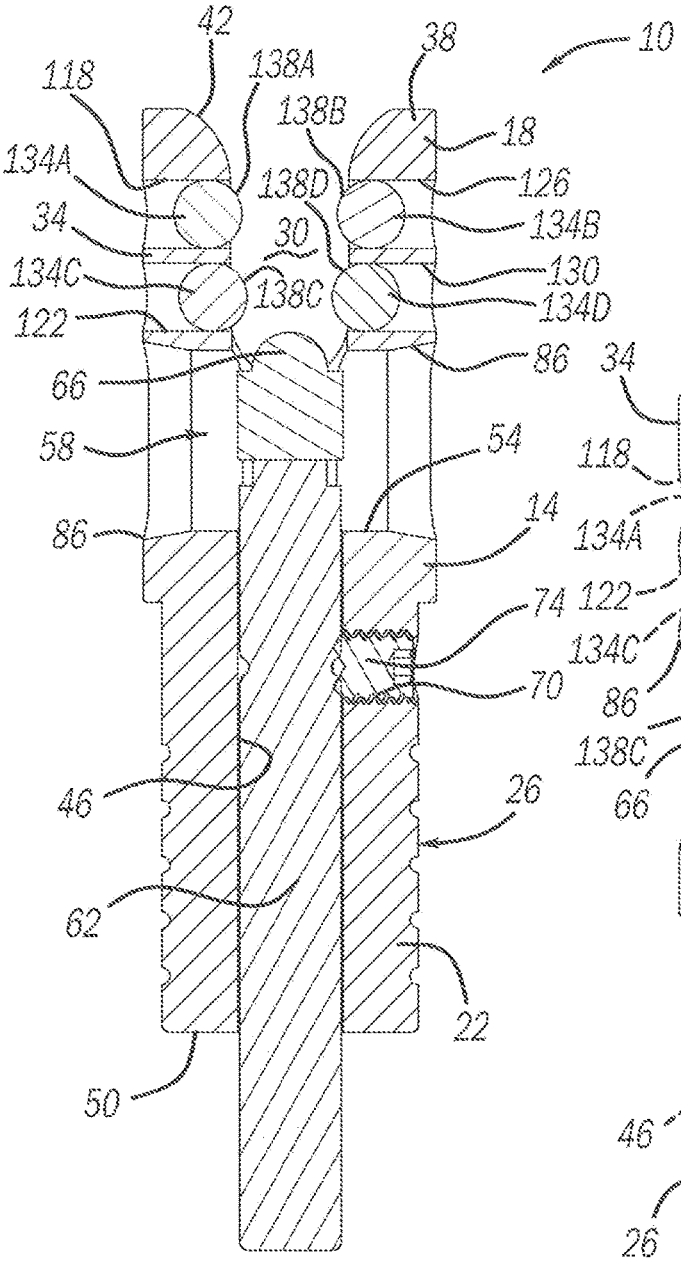
FIG. 3 is a schematic, cross-sectional side view of the nock assembly of FIG. 1.
Figure 4A:
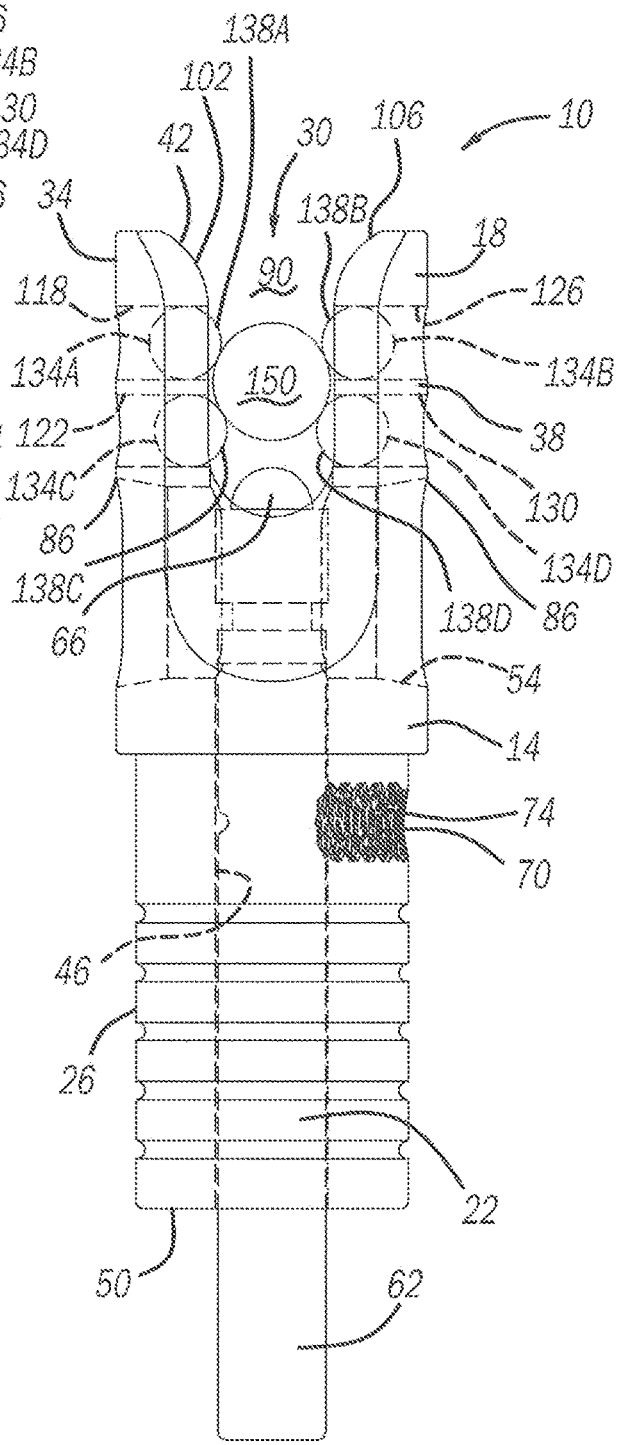
FIG. 4A is a schematic, side view of the nock assembly of FIG. 1 with a light emitting diode in a first position and a bowstring tangentially contacting the first, second, third, and fourth ball bearings.
Figure 4B:
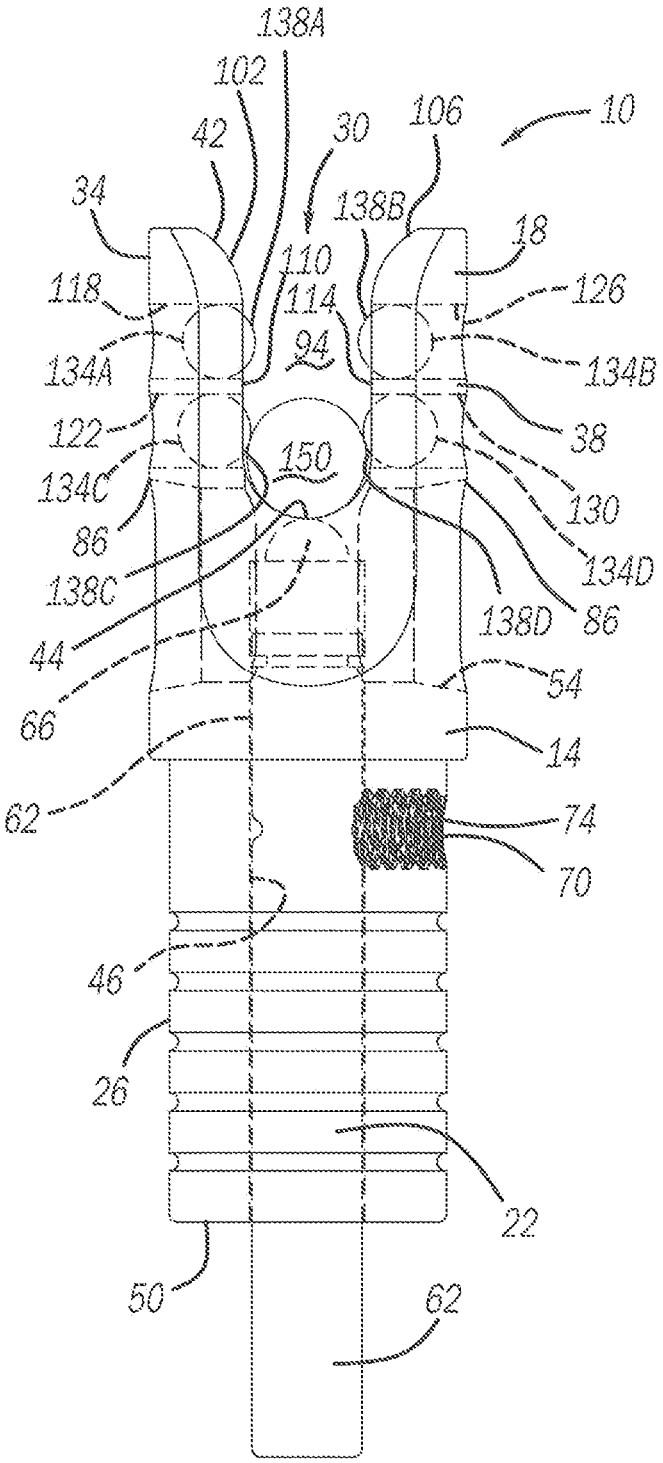
FIG. 4B is a schematic, side view of the nock assembly of FIG. 1 with the light emitting diode in a second position and the bowstring contacting the terminal end of the notch.

The nock assembly 10 also includes a light device 58, which includes a battery 62 and a light emitting device, which, in the embodiment depicted, is light-emitting diode 66 but could, for example, be an incandescent lamp within the scope of the claimed invention. The light device 58 includes a circuit operatively interconnecting the battery 62, the light-emitting diode 66, and a switch member. The switch member is movable to selectively open and close the circuit and thereby selectively turn the light-emitting diode 66 on and off. In the embodiment depicted, the switch member is the light-emitting diode 66 but could be a separate member within the scope of the claimed invention. More specifically, the light-emitting diode 66 is movable relative to the battery 62 and the nock body 14 between a first position, as shown in FIGS. 1-4A, and a second position, as shown in FIG. 4B.

The light device 58 is configured such that the circuit is closed when the light-emitting diode 66 is in the second position and the circuit is open when the light-emitting diode 66 is in the first position. Accordingly, the light-emitting diode 66 receives electrical energy from the battery 62 and thereby produces visible light when the light-emitting diode is in the second position; the light emitting diode 66 is electrically disconnected from the battery 62, and thus does not emit light, when the light-emitting diode 66 is in the first position.

The light device 58 is connected to the nock member 14 such that the battery 62 is at least partially disposed within the first bore 46. In the embodiment depicted, the nock member 14 defines a threaded hole 70 that extends from the outer surface 26 to the first bore 46. A set screw 74 is engaged with, and extends through, the hole 70 and contacts the battery 62 to secure the battery to the nock body 14 within the first bore 46.

The light emitting diode 66 extends from the first bore 46, through the terminal end 44, and into the notch 30 when the light-emitting diode 66 is in the first position. The light emitting diode 66 is movable from the first position to the second position by moving the light emitting diode 66 away from the opening 42. When the light emitting diode 66 is in the second position, the light emitting diode 66 is within the first bore 46 and the second bore 54, and is aligned with two openings 86 of the second bore 54. More specifically, the light-emitting diode 66 is approximately at the intersection of the first bore 46 and the second bore 54. The openings 86 to the second bore 54 are formed on opposite sides of the nock body 14. Thus, light emitted by the light emitting diode 66 is transmitted out of the nock body 14 through the two openings 86 of the second bore 54 and through the opening 42 of the notch 30, which receives light via the first bore 46. Once the bowstring has been removed from the notch 30, there is an unobstructed path between the opening 42 and the first bore 46 through which light can travel.

Figure 5:
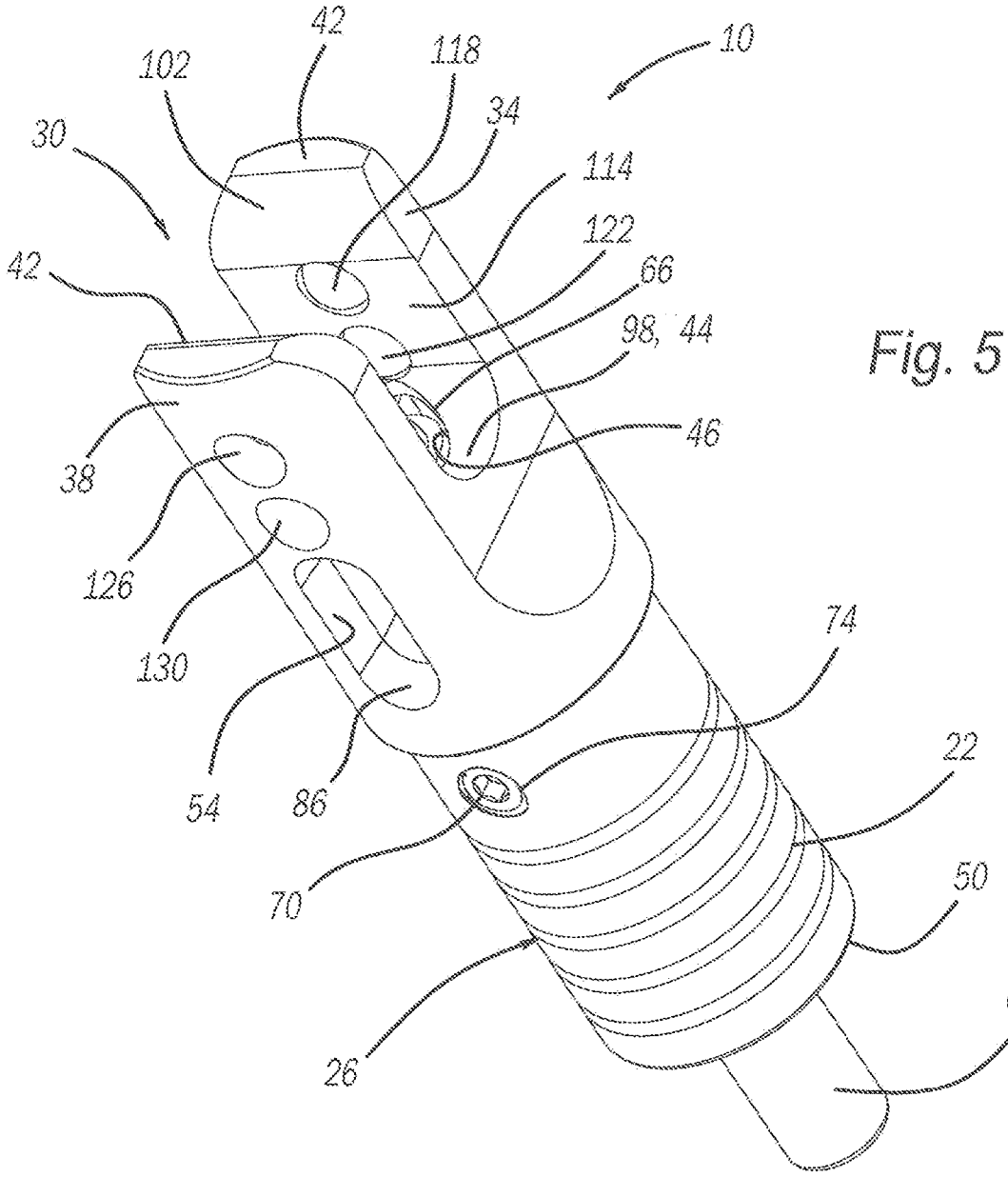
FIG. 5 is a schematic, perspective view of the nock assembly of FIG. 1.

The arms 34, 38 are configured such that the notch 30 is characterized by three segments, namely, a first segment 90, a second segment, 94, and a third segment 98. Referring specifically to FIG. 4A, arm 34 defines surface 102 and arm 38 defines surface 106. Surfaces 102, 106 define the first segment 90 therebetween and are angled relative to one another such that the first segment 90 is widest at the opening 42 to the notch 30 and gets narrower with proximity to the second segment 94. Referring to FIG. 4B, the second segment 94 is defined by two parallel surfaces 110, 114. More specifically, arm 34 defines surface 110 and arm 38 defines surface 114. Surfaces 110, 114 are substantially planar in the embodiment depicted. Referring to FIG. 5, the third segment 98 is defined by the terminal end 44 of the notch 30, and may form a portion of a cylinder, as shown in the Figures.

Arm 34 defines first and third apertures 118, 122 that extend therethrough. Arm 38 defines second and fourth apertures 126, 130 that extend therethrough. Apertures 118, 122 extend through the planar surface 110 so that apertures 118, 122 are contiguous with the notch 30. Apertures 126, 130 extend through planar surface 114 so that apertures 126, 130 are contiguous with the notch 30. The first aperture 118 and the second aperture 126 are aligned with one another such that they share a common centerline. Similarly, the third aperture 122 and the fourth aperture 130 are aligned with each other such that they share a common centerline. All four apertures 118, 122, 126, 130 have the same diameter in the embodiment depicted. The centerline of apertures 118, 126 and the centerline of apertures 122, 130 are parallel to one another.

The nock assembly 10 further includes first, second, third, and fourth substantially spherical balls 134A, 134B, 134C, 134D. In the embodiment depicted, the spherical balls 134A-D are steel and are the type used in ball bearings. The balls themselves are sometimes referred to by those skilled in the art as "ball bearings" and may be referred to as such herein. The nock body 14 is metal, such as aluminum or titanium. Each of the ball bearings 134A, 134B, 134C, 134D is press-fit into a respective one of the apertures 118, 122, 126, 130 such that a portion of each ball bearing 134A, 134B, 134C, 134D protrudes from one of the surfaces 110, 114 into the notch 30, thereby forming a respective spherical cap 138A, 138B, 138C, 138D protruding into the notch 30. As understood by those skilled in the art, a spherical cap, also known as a spherical dome or spherical segment, is a portion of a sphere cut off by a plane.

More specifically, the first ball bearing 134A is press fit into aperture 118 so that a portion of the ball bearing 134A defines spherical cap 138A protruding into the notch 30 from surface 110. The second ball bearing 134B is press fit into aperture 126 so that a portion of the ball bearing 134B defines spherical cap 138B protruding into the notch 30 from surface 114. The third ball bearing 134C is press fit into aperture 122 so that a portion of the ball bearing 134C defines spherical cap 138C protruding into the notch 30 from surface 110. The fourth ball bearing 134D is press fit into aperture 130 so that a portion of the ball bearing 134D defines spherical cap 138D protruding into the notch 30 from surface 114.

The ball bearings 134A, 134B, 134C, 134D have substantially the same diameter in the embodiment depicted. Balls 134A and 134B define a first gap therebetween and form a first constriction of the notch 30. Balls 134C and 134D define a second gap therebetween and form a second constriction of the notch 30.

The nock portion 18 is configured so that, when the nock assembly 10 is attached to an arrow or bolt, as shown at 152 in FIG. 6, the bowstring of a bow or crossbow is insertable into the notch 30 to retain the bowstring with respect to the arrow or crossbow bolt prior to the arrow or crossbow bolt being launched. As understood by those skilled in the art, a typical bow includes limbs with a bowstring 150 attached thereto such that when the bowstring is moved to a drawn position, the limbs are elastically deformed and store potential energy. An arrow having a nock is operatively engaged with the bowstring such that when the bowstring is released from its drawn position, the stored energy from the limbs is transferred to the nock via the bowstring as kinetic energy.

Similarly, a typical crossbow includes a bow portion, sometimes referred to as a "lath" or a "prod," mounted with respect to a stock. The bowstring 150 is mounted to the bow portion and is extendable to a drawn or "cocked" position. Movement of the bowstring 150 to the cocked position elastically deforms the bow portion. A mechanism locks the bowstring in the "cocked" position such that the bow portion stores a large amount of potential kinetic energy. Crossbows also typically include a rail defining a groove. The arrow or bolt 152 is loaded by placing the arrow or bolt 152 at least partially within the groove and in engagement with the cocked bowstring 150. The bowstring 150 is released from its cocked position by pulling a trigger, which causes the bowstring to transfer the stored kinetic energy to the bolt, which is then launched from the crossbow. A crossbow is shown and described in U.S. Patent Publication 2021/0172698, published Jun. 10, 2021, and which is hereby incorporated by reference in its entirety.

During use of the nock assembly 10, the bowstring 150 is inserted into the notch 30 via the opening 42. The tapered first segment 90 assists a user in inserting the bowstring 150 into the notch 30. The bowstring 150 is then moved through the first gap (between spherical caps 138A and 138B) to the position shown in FIG. 4A. The diameter of the bowstring 150 is greater than the distance between ball bearings 134A-134B, and thus resistance must be overcome for the bowstring 150 to pass through the first gap between the ball bearings 134A, 134B.

The ball bearings 134A-D and the positions of the apertures 118, 122, 126, 130 are configured such that a cylinder can be simultaneously in tangential contact with all four of the ball bearings 134A-D, and more specifically in simultaneous tangential contact with all for spherical caps 138A-D, as shown in FIG. 4A. The portion of a bowstring 150 (of a bow or crossbow) extending through the notch 30 is approximately cylindrical, i.e., has an approximately circular cross-sectional shape.

The bowstring 150 is captured in the position shown in FIG. 4A, in which the bowstring 150 simultaneously and tangentially contacts all four ball bearings 134A-134D. More specifically, the bowstring 150 simultaneously and tangentially contacts all four spherical caps 138A-D. Ball bearings 134A, 134B resist the bowstring 150 from moving toward the opening 42 and exiting the notch 30, and thus ball bearings 134A, 134B resist the bowstring 150 from disengaging with the arrow or bolt 152 to which the nock assembly 10 is attached. The second gap (between ball bearings 134C, 134D) is narrower than the diameter of the bowstring 150, and thus ball bearings 134C, 134D prevent the bowstring 150 from reaching the terminal end 98 of the notch 30 until the bowstring 150 exerts enough force to snap past the ball bearings 134C, 134D when the bowstring 150 is released. Accordingly, ball bearings 134C, 134D prevent the bowstring 150 from moving the LED 66 to its second position until the arrow or bolt is fired (i.e., when the bowstring 150 is released from its drawn or cocked position).

When the bowstring 150 is released, enough force is exerted to deform the bowstring 150 and/or the ball bearings 134A-D sufficiently to allow the bowstring 150 to pass through the second gap between the spherical caps 138C, 138D to reach the terminal end 98 and cause the LED 66 to illuminate, as shown in FIG. 4B. More specifically, as the bowstring 150 moves toward the terminal end 98 when released, the bowstring 150 acts on the light emitting diode 66, moving the light emitting diode 66 from the first position to the second position, thereby closing the circuit and causing the light emitting diode 66 to emit visible light. Sufficient force is also exerted during launching or firing the arrow or bolt 152 to permit movement of the bowstring 150 out of the notch 30 (i.e., through the first and second gaps) for the arrow or bolt 152 to be released from the bowstring 150 and propelled from the bow or crossbow.

In one embodiment, the gap between the first and second ball bearings 134A, 134B is a few thousandths of an inch larger than the gap between the third and fourth ball bearings 134C, 134D to make insertion of the bowstring into the position shown in FIG. 4A easier than the insertion of the bowstring into the position shown in FIG. 4B.

In one embodiment, the ball bearings are comprised of steel.

The use of set screw 74 facilitates replacement of the battery 62 and/or the LED 66. The nock assembly 10 improves upon the prior art by avoiding the use of glue or adhesives, the use of weak plastic, and the elimination of O-rings. The nock assembly 10 is not as affected by hot and cold temperatures as prior art nocks, is 100% waterproof, and can be weighed in exact grains.

Referring to FIG. 6, the nock assembly 10 is shown operatively connected to an arrow 152. The arrow 150 includes a cylindrical shaft 154, an arrowhead 158 mounted at a first end 162 of the shaft 154, and a plurality of vanes 166 attached to the shaft 154 adjacent a second end 170 of the shaft 158 and extending radially outward therefrom to form fletching, as understood by those skilled in the art. The shaft 154 defines an aperture at the second end 170 having a press-fit engagement with the outer surface 26 of the stem portion 22 to retain the nock assembly 10 to the shaft 154. The opening 42 of the notch 30 faces rearward to receive a bowstring.

In the embodiment depicted, the spherical caps 138A, 138B, 138C, 138D protruding from surfaces 110, 114 are formed by the spherical balls 134A, 134B, 134C, 134 extending into the notch from apertures 118, 122, 126, 130. However, it should be noted that other configurations for forming protuberant spherical caps 138A, 138B, 138C, 138D from surfaces 110, 114 may be employed within the scope of the claimed invention.

For example, within the scope of the claimed invention, and without limitation, the spherical caps 138A, 138B, 138C, 138D may be formed, such as by stamping, casting, etc. in the same piece of material that defines the surfaces 110, 114 from which they protrude. In one embodiment (not shown) within the scope of the claimed invention, surfaces 110, 114 are formed by one or more pieces of spring steel, and the spherical caps 134A, 134B, 134C, 134D are formed in the one or more pieces of spring steel.

While the best modes for carrying out the disclosure have been described in detail, those familiar with the art to which this disclosure relates will recognize various alternative designs and embodiments for practicing the disclosure within the scope of the appended claims.

The invention claimed is:

1. A nock assembly for engagement with a bow or crossbow having a bowstring, the nock assembly comprising:

a nock body having a first arm having a first surface and a second arm generally parallel to the first arm and having a second surface;

said first and second surfaces defining a notch therebetween;

said notch having a first end and a second end;

wherein the first arm and the second arm cooperate to define an opening to the notch through which the bowstring is insertable into the notch at the first end;

first and second spherical caps protruding into the notch from the first and second surfaces, respectively;

said first and second spherical caps defining a first gap therebetween, said first gap being sized such that the first and second spherical caps resist passage of the bowstring through the first gap.

2. The nock assembly of claim 1, further comprising:

a light assembly configured to selectively emit light and including a switch member that is movable relative to the nock body between first and second positions;

wherein the light assembly is configured such that the light assembly does not emit light when the switch member is in the first position, and the light assembly emits light when the switch member is in the second position;

wherein the switch member in the second position is further from the opening than the switch member in the first position.

3. The nock assembly of claim 2, wherein the first and second spherical caps are between the opening and the switch member.

4. The nock assembly of claim 3, further comprising:

third and fourth spherical caps that protrude into the notch from the first and second surfaces, respectively;

said third and fourth spherical caps defining a second gap therebetween, said second gap being sized such that the third and fourth spherical caps resist passage of the bowstring through the second gap.

5. The nock assembly of claim 4, wherein the first, second, third, and fourth spherical caps are sized and positioned such that the bowstring is positionable within the notch such that the bowstring simultaneously contacts the first, second, third, and fourth spherical caps.

6. The nock assembly of claim 4, wherein the nock body defines first, second, third, and fourth apertures;

said first and said third apertures extending through the first arm;

said second and fourth apertures extending through the second arm;

first, second, third, and fourth ball bearings, each of the ball bearings being press-fit into a respective one of the first, second, third, and fourth apertures such that a portion of said first, second, third, and fourth ball bearings protrudes into the notch and forms a respective one of the spherical caps.

7. The nock assembly of claim 6, wherein the ball bearings are steel; and wherein the nock body is aluminum or titanium.

8. The nock assembly of claim 4, wherein the first gap is larger than the second gap.

9. The nock assembly of claim 4, wherein the light assembly includes a light-emitting diode; and wherein the light-emitting diode forms at least a portion of the switch member.

10. The nock assembly of claim 9, wherein the nock body defines a first bore that extends from the second end of the notch such that the first bore is contiguous with the notch;

wherein the nock body defines a second bore that is perpendicular to the first bore and that has first and second lateral openings;

wherein the switch member is configured such that the light-emitting diode is at the intersection of the first bore and the second bore when the switch member is in the second position.

11. An arrow assembly for use with a bow or crossbow having a bowstring, the arrow assembly comprising:

a shaft;

a nock assembly mounted at one end of the shaft;

the nock assembly including a nock body having a first arm having a first surface and a second arm generally parallel to the first arm and having a second surface;

said first and second surfaces defining a notch therebetween;

first, second, third, and fourth spherical caps protruding into the notch;

wherein the first and second spherical caps define a first gap therebetween; and wherein the second and third spherical caps define a second gap therebetween.

12. The arrow assembly of claim 11, further comprising:

a light assembly configured to selectively emit light and including a switch member that is movable relative to the nock body between first and second positions;

wherein the light assembly is configured such that the light assembly does not emit light when the switch member is in the first position, and the light assembly emits light when the switch member is in the second position; and wherein the switch member extends into the notch in the first position.

13. The arrow of claim 12, wherein the nock body defines first, second, third, and fourth apertures;

said first and said third apertures extending through the first arm;

said second and fourth apertures extending through the second arm;

first, second, third, and fourth ball bearings, each of the ball bearings being press-fit into a respective one of the first, second, third, and fourth apertures such that a portion of each of the first, second, third, and fourth ball bearings protrudes into the notch and forms a respective one of the spherical caps.

14. The arrow of claim 13, wherein the notch has a first end and a second end;

wherein the first and second arms defining an opening through which the bowstring is insertable into the notch at the first end;

wherein the first, second, third, and fourth spherical caps are between the switch member and the opening.

15. The arrow of claim 14, wherein the nock is configured such that the bowstring is positionable in a first position such that the bowstring extends between the first and second arms and is in simultaneous contact with the first, second, third, and fourth spherical caps; and wherein the nock is configured such that, when the bowstring is released, the bowstring moves relative to the nock body to a second position in which the bowstring contacts the switch member.

16. The arrow of claim 12, wherein the first, second, third, and fourth ball bearings are positioned such that a cylinder can be in simultaneous tangential contact with all of the first, second, third, and fourth ball bearings.

* * * * *